United States Patent [19]

Tsujimura

[11] 4,196,887

[45] Apr. 8, 1980

[54] VEHICLE SUPPORT

[75] Inventor: Tozaburo Tsujimura, Fujinomiya, Japan

[73] Assignee: Yasui Sangyo Co., Ltd., Fujinomiya, Japan

[21] Appl. No.: 905,957

[22] Filed: May 15, 1978

[30] Foreign Application Priority Data

Dec. 28, 1977 [JP] Japan ..... 52-176526[U]

[51] Int. Cl.[2] ..... B66F 7/16

[52] U.S. Cl. ..... 254/89 H

[58] Field of Search ..... 187/8.41, 8.59, 8.45, 187/8.54; 254/134, 89 R, 89 H, 90–92; 269/258

[56] References Cited

U.S. PATENT DOCUMENTS

| | | | |
|---|---|---|---|
| 1,348,148 | 8/1920 | Bergstrom | 269/258 |
| 2,593,635 | 4/1952 | Walker | 254/89 H |
| 3,724,602 | 4/1973 | Hernick | 187/8.54 |
| 3,779,517 | 12/1973 | Fisher | 254/134 |
| 4,050,673 | 9/1977 | Nishimura | 254/89 H |
| 4,086,982 | 5/1978 | Hernick | 187/8.54 |

FOREIGN PATENT DOCUMENTS

| | | | |
|---|---|---|---|
| 2340349 | 2/1974 | Fed. Rep. of Germany | 254/89 R |

*Primary Examiner*—Robert C. Watson

[57] ABSTRACT

A vehicle support for use in a vehicle lift having a carriage sliding up and down a pillar, which comprises a supporting platform pivotally attached to the ends of supporting arms which slide in support tubes attached to the carriage.

5 Claims, 3 Drawing Figures

VEHICLE SUPPORT

Figure 1:
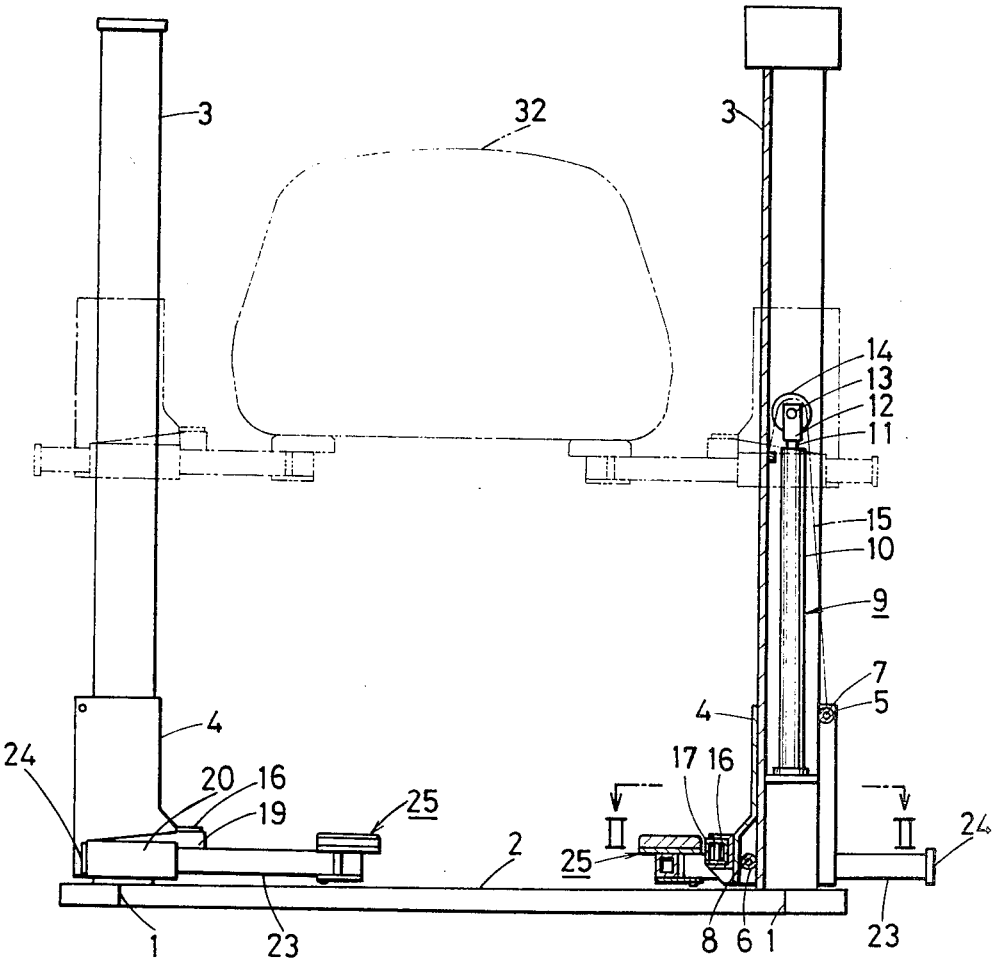

This invention relates to a vehicle support for a vehicle lift which comprises a carriage which slides up and down a support pillar, and which is attached to the carriage.

For the sake of convenience in the inspection and repair of the underside of automobiles or other vehicles, and for cleaning or painting them, and so forth, a two-pillar vehicle lift is widely used. Such a lift has two support pillars on each of which is mounted a carriage which slides up and down. On each carriage is installed a vehicle support which comprises an inwardly facing extending support arm. These support arms are inserted under the body or chassis of the vehicle to be lifted, from both sides, and then, as the carriages are simultaneously raised, the vehicle is lifted until it is held at the desired height.

In most of these conventional vehicle lifts the vehicle is supported by two support arms on each side which extend inwardly independently from each carriage, and which can pivot around vertical axes or be extended inward and outward with respect to the carriage, independently. Thus each of these four independent support arms needs to be located to an independent position on the underside of the chassis or the body of the vehicle, and this can cause considerable complications.

One, for instance, of these is that since the vehicle is supported at four points independently, because of inevitable differences in the heights of the various support members due to wear, damage, manufacturing tolerances, etc., in reality the vehicle will actually be supported at only three points, and this is an unstable situation. In fact, there is a danger that if a mechanic who is working on the vehicle accidentally knocks the support arm that is not bearing a substantial load he may dislodge it from underneath the vehicle. Since then it is quite likely that the center of gravity of the vehicle will be substantially near to or on a position vertically over the line joining two of the remaining support arms, there is a danger of the vehicle falling and causing a disastrous accident.

Therefore, the first object of the present invention is to provide a vehicle support for a vehicle lift which makes it easy to adjust the positions of the supports to the vehicle and also ensures that the vehicle is supported stably.

Another object of the present invention is to provide a vehicle support for a vehicle lift which enables a supporting platform attached to the support to be moved smoothly and freely within the adjustment bounds provided without any danger that the vehicle may be supported unstably.

According to the present invention, in order to progress towards either or both of these objectives, there is provided, in a vehicle lift in which a vehicle is raised up by a carriage which moves along a support pillar, a vehicle support attached to the carriage comprising two parallel support tubes attached to the carriage at substantially the same height, two support arms slidably inserted in the support tubes, and a substantially horizontal support platform pivotally attached to a free end of each of the support arms around a vertical axis.

Figure 2:
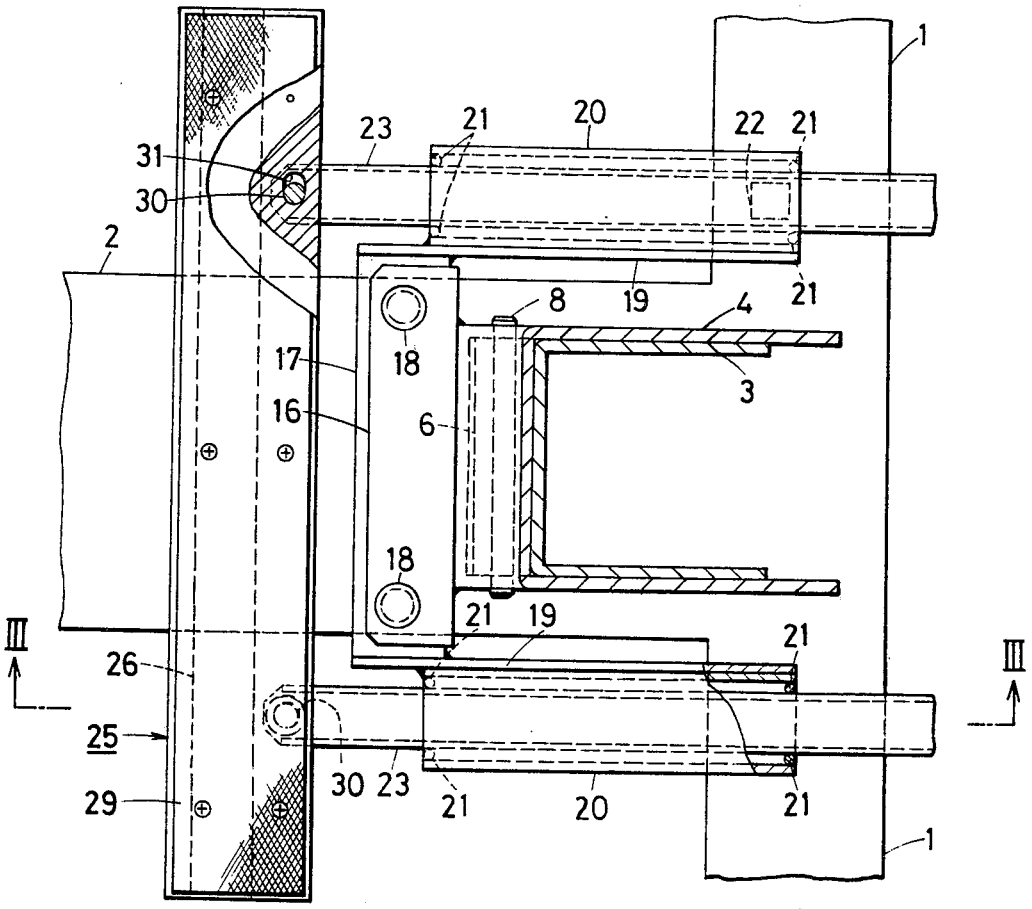
Figure 3:
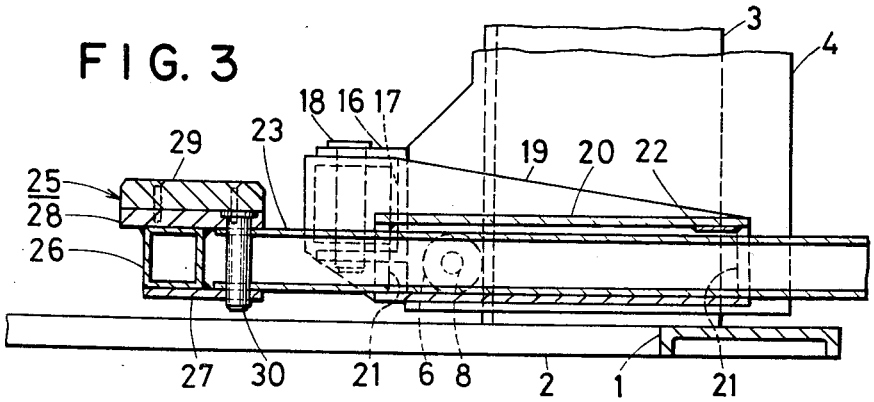

Other objects, features, and advantages of the present invention will become more clear from the detailed description given below of a preferred embodiment of the invention, taken in conjunction with the accompanying drawings. It should however be understood that the invention may take other forms than that of the illustrated embodiment and of the drawings, which are given for illustrative purposes only, and thus are not intended to be limitative of the present invention. The scope of protection of the present invention is intended to be delimited solely by the appended claims. In the drawings, FIG. 1 is a front view, partly cut away, of an embodiment of the present invention incorporated in a two-pillar lift;

FIG. 2 is a plan view of the vehicle support of FIG. 1, partly cut away along the line II—II of FIG. 1; and FIG. 3 is a sectional diagram of the vehicle support of FIG. 2, along the line III—III of FIG. 2.

With reference now to FIG. 1, a level base 2 is provided with support legs 1 extending forwards and backwards at the right and left portions thereof, as seen in the orientation illustrated in the drawing. On this base a pair of left and right pillars 3 stand, each of which is in horizontal section approximately of an outward-facing U-shape.

The left and right pillars 3, the carriages 4 hereinafter described, and the associated mechanisms are arranged in a fashion which is completely symmetrical between left and right. In the following description, therefore, explanation will be given only for the right hand pillar 3 and carriage 4.

To each of the pillars 3, then, is fitted a carriage 4 which can slide up and down the pillar, and which is also in horizontal cross-section of a roughly U-shape facing outwards.

At an outward upper portion and an inward lower portion of the carriage 4 are provided rollers 5 and 6 mounted on horizontal shafts 7 and 8 running from front to back as seen in FIG. 1. As these rollers 5 and 6 roll on the inward and the outward side surfaces of the pillar 3, the carriage is enabled to move up and down easily and lightly on the pillar 3.

In the embodiment shown in the diagrams, the raising and the lowering of the carriage 4 is performed by a cylinder-piston type expansion device 9 mounted in the center of one of the pillars 3.

At the top end portion of the piston 11 of the expansion device 9, a fork-like bearing support 12 is provided, and this support 12 supports a horizontal shaft 13 extending forwards and backwards in the figure. On this horizontal shaft 13 is rotatably mounted a pulley 14, and a cable 15 made of wire, chain, or the like is wound around the pulley 15. One end of the cable 15 is fixed to the center of or somewhat below the middle portion of the pillar 3, and the other end of the cable 15 is connected to the center of the shaft 7 of the roller 5 on the carriage 4.

When hydraulic pressure is supplied to the expansion device 9 from a means not shown in the drawing, the piston 11 is driven out from the cylinder 10 of the expansion device 9, and thereby the pulley 14 is moved upwards, and so, via the cable 15, the carriage 4 is raised. Similarly, when hydraulic fluid is exhausted from the expansion device 9 the carriage is lowered.

As is shown in FIGS. 2 and 3, on a lower portion of the inner side of the carriage 4 is fixed a bracket 16 whose cross-section viewed from the front as seen in FIG. 1 is an inward-facing U-shape.

In this bracket 16 is inserted a square tubular side member 17 disposed horizontally in a front to rear direction as seen in the drawings. This side member 17 is held in the bracket 16 by two pins 18 protruding from the upper part of the bracket 16.

Vertical plates 19 are fixed on the outside end surfaces of the front and the rear of the side member 17, which protrude somewhat from the bracket 16. To the front surface of the front vertical plate 19 and to the back surface of the back vertical plate 19 are fixed horizontal support tubes 20 of a square tubular form, at a position somewhat below that of the side member 17.

In each of the right and the left opening ends of each of the support tubes 20 are fixed a pair of cylindrical guide pins 21, disposed in vertical axes. Further, inside the right end as seen in the figures of each support tube 20 is fixed a friction plate 22 to the upper inner surface of the support tube 20.

Support arms 23 of square tubular form are inserted into the support tubes 20 and they are able to slide in and out of these support tubes, being guided between the guide pins 21 at the left and right ends of the support tubes. Pressure of the right hand ends of these support arms 23 upwards on the inside of the right hand end of the support tubes 20 is borne by the friction plates 22. At the outer end of the support arms 23 are attached stop plates 24 which prevent the support arms from being pulled out to the left from the support tubes 20.

To the left hand ends as seen in the figures of the support arms 23 is connected a platform 25. This platform, in more detail, comprises a square tubular support girder 26 disposed horizontally in a front to rear direction, a lower plate 27 fixed on the underside of this girder 26 and projecting somewhat outwards from under it to the right, a wide middle plate 28 fixed on the upper side of the girder 26 and also projecting somewhat both to the left and the right sides of the girder 26, and an upper plate 29 fixed on the upper side of this middle plate 28 and formed with a rough surface on its upper side to prevent slipping.

This platform 25 is secured to the left hand ends of the support arms 23 in the following manner. Vertical shafts 30 are provided which are supported at their upper and lower ends by the middle plate member 28 and the lower plate 27. In the embodiment shown in the drawings, the shaft holes in the platform 25 for supporting the rear shaft 30 are in fact formed as slots 31 running in a front to rear direction for a short distance, as shown in FIG. 2. The vertical shafts 30 pass through holes in the support arms 23. Thus it is seen that the platform 25 is pivoted to both the support arms 23 around a vertical axis, and that in this embodiment one of the pivots is movable to a certain extent with respect to the support platform substantially in the direction of the line between the two pivotal attachments.

When this car lift is being used, the procedure to be adopted is as follows. The right and the left carriages 4 are lowered to their lowest positions, and the right and left platforms 25 are moved to the positions closest to the pillars 3, as is shown for the right hand platform in FIG. 1. Then a vehicle designated in FIG. 1 as 32 is driven in between the pillars and stopped. Then the left and the right platforms 25 are pulled inwards, and inserted from both sides to suitable positions under the vehicle body or chassis, between the front wheels and the rear wheels of the vehicle.

During this adjustment process of locating the support platforms at appropriate places underneath the vehicle, of course they can be freely moved inward and outward by sliding the arms 23 in the tubes 20. However, also to a limited extent each support platform can be moved angularly about a vertical axis, so as to coapt it to various vehicles, due to the provision of the slot 31, which allows the pin 30 to move back and forth to a limited extent within it so as to vary to a limited extent the distance between the two pins 30, which needs to vary if the support platform is to move angularly about a vertical axis.

This angular movement is automatically limited due to the limited length of the slot 31. By adjusting during manufacture of the car lift the length of the slot 31, the amount of freedom allowed to the support platforms to alter their orientation about a vertical axis, and thus the amount by which the front ends of the platforms may be closer or further apart from one another than their rear ends, may be adjusted, as desired.

However, the provision of the slot 31 is not strictly necessary for the advantages of the present invention to be realized. If there were no manufacturing errors during production of the car lift, and hence there were no play in the assembly of the tubes 20, the support arms 23, and the platform 25, then of course the provision of pivots 30 would be of no practical effect, as pivoting would be inhibited due to dimensional constraints. However, in practical terms free play in the various places where relative movement of components takes place is unavoidable, and therefore, even if no slot 31 is provided, the platforms 25 will be able to move to a limited extent angularly about a vertical axis, until the free play is taken up and movement is inhibited.

Of course, after the platforms 25 have been positioned under the vehicle in appropriate positions, by means of the expansion devices 9 provided within the pillars 3 the carriages 4 are simultaneously raised, and thus the vehicle can be raised to the desired height, as shown by the two-dotted lines in FIG. 1.

There is another advantage in the concept of the present invention of pivoting the platform 25 to the support of arms 23. In practical circumstances in a garage or other place where the vehicle lift is being used, it often happens that the operators may use the equipment somewhat roughly, and if there were no pivoting at the points where the platform 25 was joined to the support arms 23 then any twisting moment imparted to the platforms would be directly transmitted to the support arms, and it might occur that they would jam in the support tubes 20, against its sides. However, since pivoting is provided, twisting moment imparted during careless handling is not transmitted directly to these arms within the limits of the freedom given to the assembly, and hence jamming is more positively avoided.

Yet another advantage in the device of the present invention, over the previously conceived four-support lifts as described above, is that because only two supporting members are provided they can be adjusted underneath the vehicle much more quickly, easily, positively, securely, and safely than if they were four in number. The substantial reduction in manufacturing costs of a device of the present invention will also be apparent.

Further features of the construction of the embodiment described are as follows. The guide pins 21 are provided in order further to ensure that the support arms 23 should not jam in the tubes 20, by holding them in a kind of pinch grip. Further, the friction plate 22 is provided so that when a vehicle is supported on the lift a high force is caused between the arm 23 and the plate, and thus the arm 23 is locked positively in the tube 20 so that it can neither move in nor out of it. This is an important safety feature. Yet further, since the side member 17 is attached to the bracket 16 by the removable pins 18, by removing these pins the entire body of the lifting means can be detached from the carriage, and then, for instance, a device of the well-known "swing-arm" kind can be attached instead. Thus the supporting system of the present invention and the well-known "swing-arm" device can be used selectively according to particular requirements.

In the described embodiment of the present invention the support has been described as used in a two-pillar lift. However, the present support is not restricted to use with a two-pillar lift, but may be used as part of a single-pillar or other type of vehicle lift. Moreover, many changes and modifications are possible to the structure of the lift and the supports without exceeding the limits of the present invention. Therefore it should be understood that the extent of the exclusive property sought to be granted for the present invention is not to be defined by any particular features of the illustrative embodiment which has been given, but only by the appended claims.

What is claimed is:

1. In a vehicle lift in which a vehicle is raised up by a carriage which moves along a support pillar, a vehicle support attached to the carriage comprising:

two parallel support tubes attached to the carriage at substantially the same height, two support arms slidably inserted in the support tubes, and a substantially horizontal support platform pivotally attached to a free end of each of the support arms around a vertical axis.

2. A vehicle support as in claim 1, wherein the pivotal attachment of the support platform to at least one of the support arms is constructed as a pivot movable to a certain extent with respect to the support platform substantially in the direction of the line between the two pivotal attachments.

3. A vehicle support as in claim 2, wherein the said movable pivot or pivots is constructed by a shaft attached to the support arm being movable in a slot in the support platform.

4. A vehicle support as in claims 1, 2, or 3, wherein inside each support tube at each of its ends are provided a pair of cylindrical guide pins positioned in substantially vertical axes in a manner of guiding the support arms to slide freely between them.

5. A vehicle support as in claims 1, 2, or 3, wherein at the end of each support arm which is not attached to the support platform there is attached a stop member larger than the aperture of the support tube, in a manner to prevent the passage of that end therethrough.

* * * * *